United States Patent [19]

Becker

[11] 4,215,720

[45] Aug. 5, 1980

[54] FLUID CONTROL VALVE SYSTEM

[75] Inventor: Lanson Becker, Galesburg, Mich.

[73] Assignee: General Signal Corporation, Stamford, Conn.

[21] Appl. No.: 947,984

[22] Filed: Oct. 2, 1978

[51] Int. Cl.[3] ..... F15B 13/08

[52] U.S. Cl. ..... 137/596.2; 91/451; 91/516; 137/596.13

[58] Field of Search ..... 137/596.13, 596.2; 91/451, 516

[56] References Cited

U.S. PATENT DOCUMENTS

| | | | |
|---|---|---|---|
| 3,722,543 | 3/1973 | Tennis | 137/596.13 X |
| 3,782,404 | 1/1974 | Hodgson . | |
| 3,807,447 | 4/1974 | Masuda . | |
| 3,911,942 | 10/1975 | Becker . | |
| 3,926,210 | 12/1975 | Rasmussen | 137/596.12 |
| 3,934,742 | 1/1976 | Tennis . | |
| 4,003,202 | 1/1977 | Becker . | |
| 4,043,419 | 8/1977 | Larson | 60/384 X |

*Primary Examiner*—Gerald A. Michalsky
*Attorney, Agent, or Firm*—Jeffrey S. Mednick; Thomas R. FitzGerald

[57] ABSTRACT

Fluid control valve apparatus is provided having a directional control valve for metering passage of fluid from a supply passage to a feeder passage for first actuator. A pressure compensating valve is provided for regulating flow through the directional control valve and for delivering excess fluid to a compensating valve output port for power operation of a second actuator. A main relief valve is connected to the first actuator feeder passage downstream from a metering portion of the directional control valve for sensing a first actuator stall condition. The main relief valve, when actuated, delivers fluid to a tank from a supply passage, through the metering portion of the directional control valve, and a relief passage including the main relief valve upon sensing an overload condition. The rate of flow through the relief passage is subject to limitation only by the metering portion of the direction control valve.

5 Claims, 1 Drawing Figure

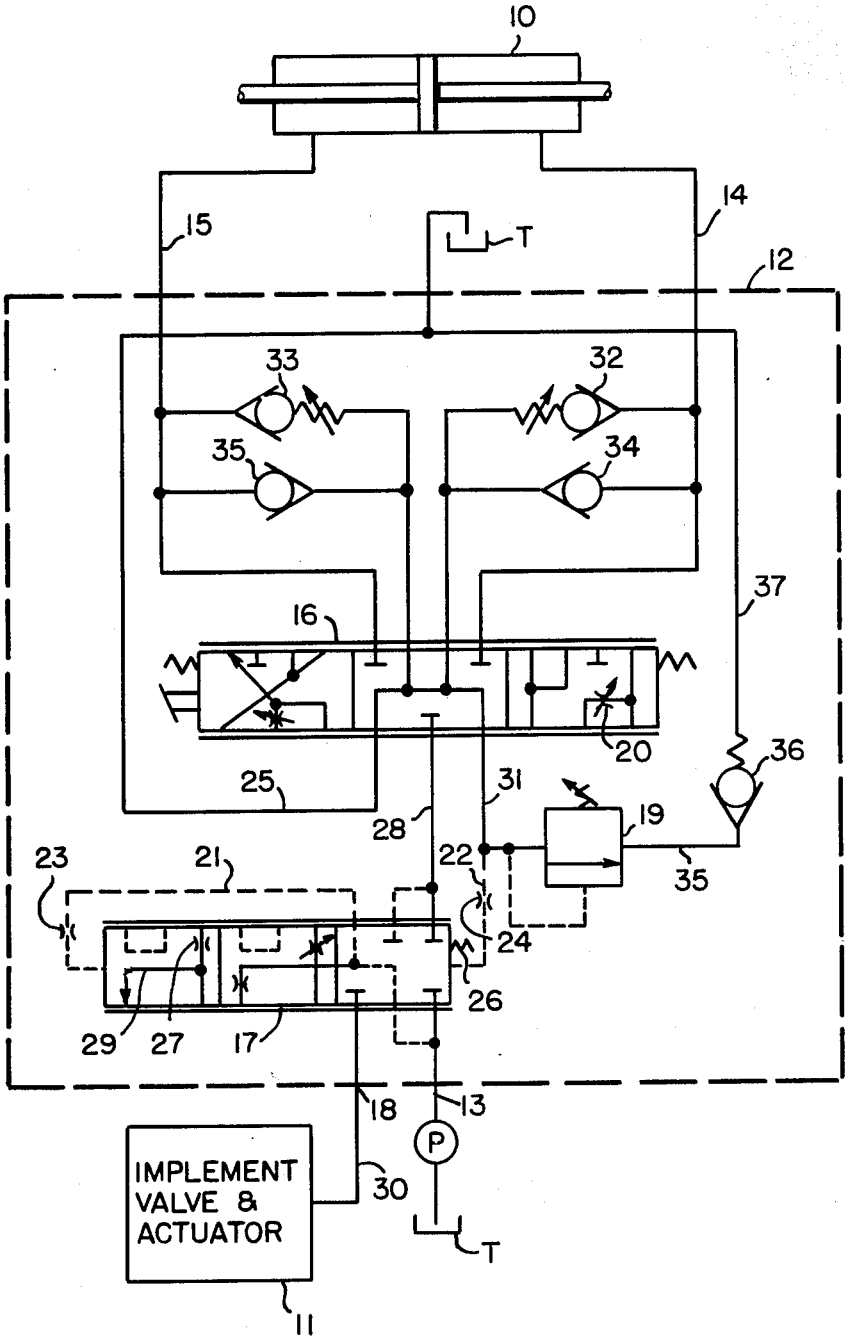
10
14
15
T
12
33
32
35
34
37
16
20
36
25
31
28
19
23
21
22
35
24
26
29
27
17
18
13
P
IMPLEMENT VALVE & ACTUATOR
30
T
11

FLUID CONTROL VALVE SYSTEM

REFERENCE TO PRIOR CASES

This invention relates to my prior U.S. Pat. Nos. 3,911,942 and 4,003,202 which are incorporated herein by reference for a better understanding of the background of the present invention.

BACKGROUND OF THE INVENTION

The present invention relates to fluid control valve systems adapted to govern fluid power operation of a plurality of fluid actuators, and it more particularly relates to an improved use of main relief valves in such systems.

In fluid control valve systems a first hydraulic actuator, for example, may govern power steering of an articulated vehicle, and a second actuator may govern operation of an implement on the vehicle. A directional control valve is used for control of the power steering in combination with a pressure compensating valve, which gives the power steering priority when a single source of fluid supply is used for actuating both the power steering and the implement. In systems for governing the operation of a plurality of fluid devices from a single source of fluid supply, it is general practice to protect the supply by a main relief valve upstream from a first directional control valve as disclosed in the Tennis U.S. Pat. No. 3,722,543, and to permit operation of a second actuator in case of stalling of a first actuator by control of a pressure compensator for the first actuator as disclosed in my U.S. Pat. No. 3,911,942. It has been found that sudden pressure changes in these systems, particularly when used for power steering, can cause shifting of metering lands of a compensating spool, with a resulting undesirable sudden change in fluid flow.

An object of the present invention is to provide a fluid control valve system which substantially obviates one or more of the limitations of the described prior art systems.

Another object of the present invention is to simplify fluid control valve systems by eliminating the need for a plurality of fluid power sources for smoothly and efficiently operating a plurality of actuators on an articulated vehicle.

Other objects, purposes and characteristic features will be in part obvious from the accompanying drawing, and in part pointed out as the description of the invention progresses.

SUMMARY OF THE INVENTION

A fluid control valve system is provided that is adapted to govern fluid power operation of first and second actuators, for example, for controlling power steering and an implement respectively on an articulated vehicle from a single source of fluid power. The control valve system has a metering directional control valve for governing passage of fluid from a supply passage to a first actuator feeder passage, and a pressure compensating valve is provided for regulating flow through the directional control valve and for delivering excess fluid to a compensating valve output port for power operation of the second actuator. A main relief valve is connected to the first actuator feeder passage downstream from a metering portion of the directional control valve for sensing stalling of the first actuator. The main relief valve governs flow of fluid to a tank from the supply passage through the metering portion of the directional control valve and a relief passage upon sensing a stalled condition. The rate of flow through the relief passage is subject to limitation only by the metering portion of the directional control valve.

For a better understanding of the present invention, together with other further objects thereof, reference is had to the following description, taken in connection with the accompanying drawing.

With reference to the drawing, a fluid control valve system is illustrated as comprising first and second fluid actuators 10 and 11, a control valve device 12, for governing passage of fluid from a supply passage 13 to a first actuator feeder passage 14 or 15, dependent upon the direction of control designated by a direction control valve 16. A pressure compensator valve 17 is provided for regulating fluid flow through the directional control valve 16 and for delivering excess fluid power to a compensating valve output port 18 for operating the second actuator 11.

When the directional control valve 16 is actuated to a left-hand operating position, a main relief valve 19 is connected to the first actuator feeder passage 14 downstream from a metering portion 20 of the directional control valve 16. When the main relief valve 19 is opened by high pressure in the feeder passage 14, it relieves the high pressure by delivering fluid to a tank T at a rate of flow limited by the metering portion 20 of the directional control valve 16.

The compensator valve 17 is subject to actuation in accordance with a difference in pressure on the opposite sides of the metering restriction 20 of the directional control valve 16 as obtained through passages 21 and 22 respectively and restrictions 23 and 24. Pressures in passages 21 and 22 are applied to the opposite ends of a spool of the compensating valve 17 to regulate flow through the metering restriction 20 of the directional control valve 16 according to usual practice.

Having thus considered the major elements and their mode of operation, the system will now be considered more in detail relative to typical operating conditions. The system is illustrated in its inactive condition, with no fluid pressure applied to the system, and with the directional control valve 16 maintained in its center position. In this position, the spring chamber at the right-hand end of the compensating valve 17 is connected to the tank T through restriction 24, passages 22 and 31, direction control valve 16 in its center position, and tank passage 25. The spring 26 has actuated the spool of compensating valve 17 to its left-hand position as is diagrammatically illustrated in the drawing.

When pressure is applied to the system by a pump P, a chamber at the left-hand end of the compensating valve 17 is pressurized at supply pressure through passage 21, and restriction 23. The compensating valve 17 immediately moves to its right-hand position and applies pressure from the supply passage 13 through a restriction 27 and passage 28 to a closed center portion of direction valve 16. Bypass of supply fluid will be applied through passage 29 of valve 17 to an output port 18 for delivery over passage 30 to the implement valve and actuator 11. This, of course, permits the operation of either or both of the steering actuator 10 and the implement 11, which will have its own control valve and overload protection in accordance with the requirements of practice.

It will now be assumed that an operator of the vehicle designates a control for operation of the steering actuator 10 by moving the direction control valve 16 to the left. This connects the supply passage 28 through metering restriction 20 to the feeder passage 14. The feeder passage 14 is also connected over passage 31 to the main relief valve 19, and through passages 31 and 22 and restriction 24 to the spring chamber at the right-hand end of the compensating valve 17. The chamber at the left-hand end of the compensating valve 17 has high pressure applied thereto through passage 13, restriction 27, passage 21 and restriction 23. This causes the compensating valve 17 to be operated by the differential in input and output pressures across the metering portion 20 of directional control valve 16 to regulate flow of fluid to the steering actuator 10.

Overload relief valves 32 and 33 are connected in passages between the power steering feeders 14 and 15 and the tank T through the direction control valve 16 in its center position and passage 25. These can be set to open, for example, at a pressure of approximately 500 psi above the setting of the main relief valve 19. These overload relief valves 32 and 33 are to relieve feedback pressures from the cylinder 10, for example, when the vehicle is passing over uneven terrain and the direction control valve 16 is on center. They are rendered ineffective by actuation of the direction control valve 16 out of its center position. The main relief valve 19, however, is operable to an open position only through the metering restriction 20 when the direction control valve 16 is in an off center position.

Anti-cavitation valves 34 and 35 are connected in multiple with overload relief valves 32 and 33 but in opposite directions to the valves 32 and 33 according to usual practice.

Having thus considered the mode of operation in applying pressure to the feeder passage 14 for actuating the power steering mechanism 10 in one direction, it should be readily apparent that a similar mode of operation is effective for operating the power steering actuator 10 in the opposite direction by fluid pressure in feeder passage 15 in accordance wit actuation of the direction control valve 16 to a right-hand position.

The main relief valve 19, when actuated, tends to maintain flow through the metering portion 20, and thus prevents undesirable quick flow changes in the fluid control valve caused by rapidly changing pressure in actuator 10 and by preventing rapid changes in the position of the lands of the compensating valve 17 for a given directional control valve 16 spool position. When the main relief valve 19 is in its actuated position, fluid flows from supply passage 28 through the metering restriction 20, passage 31, main relief valve 19, passage 35, low pressure relief valve 36 and passage 37. The use of low pressure relief valve 36 in the circuit insures that at least some operating pressure is maintained in the system in case of a malfunction of the main relief valve 19 which could cause this valve to remain in its acutated position.

Having thus described a fluid control valve system for governing fluid power controls on an articulated vehicle as a preferred embodiment of the present iventon, it is to be understood that various modifications and alterations may be made to the specific embodiment shown without departing from the spirit or scope of the invention.

What is claimed is:

1. A fluid valve system, adapted to govern fluid power operation of first and second actuating means, the control valve system having metering directional control valve means for selectively governing passage of fluid from a supply passage to a first actuator feeder passages, and pressure compensating valve means for regulating flow through the directional control valve output port for power operation of the second actuating means wherein improved control apparatus comprises;

(a) a single main relief valve means connectable to each of said first actuator feeder passages and connected to the selected one of said first actuator feeder passages downstream from a metering portion of the directional control valve means for sensing a stalled condition of the first actuator, and (b) means governed by the main relief valve means for delivering fluid to a tank from the supply passage through the metering portion of the directional control valve means and a relief passage including the main relief valve means upon sensing a stalled condition of the first actuator, and for delivering said fluid through the relief passage at a rate of flow which is limited only by the metering portion of the direction control valve means.

2. A fluid control valve system according to claim 1 wherein a relatively low pressure relief valve means is connected in series with the main releif valve and the tank for maintaining a minimum operating pressure in the system in case the main relief valve should fail to close.

3. A fluid control valve device according to claim 1 wherein the main releif valve means comprises;

(a) a main relief valve having input and output ports, (b) means including the directional control valve means for selectively connecting the relief valve input port to the selected downstream feeder passage or to the tank in accordance with whether the directional control valve means is in an operating position or in a center position respectively, and (c) means for connecting the output port to the tank.

4. A fluid control valve device according to claim 1 wherein the pressure compensating means comprises;

(a) a compensating valve operable in response to opposing pilot pressures applied thereto, and (b) means for obtaining one of the opposing pilot pressures for the compensating valve from a pilot control passage having a flow restriction that is connected to the selected feeder passage downstream from the metering portion of the direction control valve means when the direction control valve means is in an operating position and to the tank, when the direction control valve means is is a center position.

5. A fluid control valve device according to claim 4 wherein said pilot control passage is also connected to an input port of the main relief valve means.

* * * * *

UNITED STATES PATENT OFFICE

CERTIFICATE OF CORRECTION

PATENT NO. : 4,215,720

DATED : August 5, 1980

INVENTOR(S) : Lanson Becker

It is certified that error appears in the above-identified patent and that said Letters Patent are hereby corrected as shown below:

In column 4, line 9, after "actuator" insert --via a selected one of a plurality of first actuator--.

Signed and Sealed this

*Fourteenth* Day of *September 1982*

[SEAL]

*Attest:*

GERALD J. MOSSINGHOFF

*Attesting Officer*

*Commissioner of Patents and Trademarks*